US011018433B2

(12) United States Patent
Hu et al.

(10) Patent No.: US 11,018,433 B2
(45) Date of Patent: May 25, 2021

(54) TRIPLE WIDEBAND HYBRID LTE SLOT ANTENNA

(71) Applicant: SMART ANTENNA TECHNOLOGIES LTD, Birmingham (GB)

(72) Inventors: Sampson Hu, Birmingham (GB); Jinsong Song, Birmingham (GB); Qing Liu, Birmingham (GB); Liang Wan, Birmingham (GB)

(73) Assignee: Smart Antenna Technologies Ltd., Birmingham (GB)

( * ) Notice: Subject to any disclaimer, the term of this patent is extended or adjusted under 35 U.S.C. 154(b) by 97 days.

(21) Appl. No.: 16/487,058

(22) PCT Filed: Feb. 19, 2018

(86) PCT No.: PCT/GB2018/050434
§ 371 (c)(1),
(2) Date: Aug. 19, 2019

(87) PCT Pub. No.: WO2018/150202
PCT Pub. Date: Aug. 23, 2018

(65) Prior Publication Data

US 2020/0161769 A1 May 21, 2020

(30) Foreign Application Priority Data

Feb. 20, 2017 (GB) ..... 1702748
Jul. 24, 2017 (GB) ..... 1711909

(51) Int. Cl.
*H01Q 13/10* (2006.01)
*H01Q 1/38* (2006.01)
(Continued)

(52) U.S. Cl.
CPC ..... *H01Q 13/10* (2013.01); *H01Q 1/38* (2013.01); *H01Q 1/48* (2013.01); *H01Q 9/0407* (2013.01); *H01Q 9/42* (2013.01); *H01Q 1/241* (2013.01)

(58) Field of Classification Search
CPC ..... H01Q 13/10; H01Q 1/38; H01Q 1/48; H01Q 9/0407; H01Q 9/42; H01Q 1/241;
(Continued)

(56) References Cited

U.S. PATENT DOCUMENTS

2004/0108957 A1* 6/2004 Umehara ..... H01Q 1/243 343/700 MS
2004/0257283 A1 12/2004 Asano et al.
(Continued)

FOREIGN PATENT DOCUMENTS

CN 105406174 A 3/2016
GB 2533339 A 6/2016
(Continued)

OTHER PUBLICATIONS

Examination Report for GB Application No. 1802655.9, dated Sep. 26, 2019, 3 pp.
(Continued)

*Primary Examiner* — Khai M Nguyen
(74) *Attorney, Agent, or Firm* — Shumaker & Sieffert, P.A.

(57) ABSTRACT

There is disclosed an antenna arrangement for a portable electronic device. The antenna arrangement comprises a conductive ground plane having an edge and a substantially rectangular recess formed in the edge of the ground plane. The recess has a base, an open edge opposed to the base, and at least a first side extending from the base. A first conductor element extends across the open edge of the recess, a first end of the first conductor element being connected to the
(Continued)

ground plane at the first side of the recess. The first conductor element leaves at least one gap at the edge of the recess, such that the first conductor element, the first side of the recess and the base of the recess together define a slot in the ground plane and the at least one gap defines at least one notch in the slot. A second conductor element is disposed within the recess and connected to or configured to couple with the ground plane. The antenna arrangement further comprises a feed arm for connection to an RF feed, the feed arm being disposed substantially within a footprint of the slot.

27 Claims, 4 Drawing Sheets

(51) Int. Cl.

| | |
|---|---|
| ***H01Q 1/48*** | (2006.01) |
| ***H01Q 9/04*** | (2006.01) |
| ***H01Q 9/42*** | (2006.01) |
| ***H01Q 1/24*** | (2006.01) |

(58) Field of Classification Search
CPC ..... H01Q 13/16; H01Q 5/371; H01Q 5/378; H01Q 9/0421; H01Q 5/28; H01Q 5/307; H01Q 5/328; H01Q 1/2258; H01Q 1/242; H01Q 1/36; H01Q 1/44; H01Q 1/50; H01Q 13/103; H01Q 1/243; H01Q 5/00
See application file for complete search history.

(56) References Cited

U.S. PATENT DOCUMENTS

| | | | |
|---|---|---|---|
| 2008/0165063 | A1 | 7/2008 | Schlub et al. |
| 2009/0153407 | A1 | 6/2009 | Zhang et al. |
| 2011/0102272 | A1 | 5/2011 | Wong et al. |
| 2012/0154223 | A1 | 6/2012 | Oh et al. |
| 2012/0188135 | A1 | 7/2012 | Wong et al. |
| 2012/0231750 | A1 | 9/2012 | Jin et al. |
| 2013/0154888 | A1 | 6/2013 | Lin et al. |
| 2013/0214979 | A1 | 8/2013 | McMilin et al. |
| 2013/0222195 | A1 | 8/2013 | Hill et al. |
| 2014/0125534 | A1 | 5/2014 | Ishikawa |
| 2014/0320358 | A1 | 10/2014 | Wong et al. |
| 2015/0234077 | A1 | 8/2015 | Komulainen et al. |
| 2016/0118718 | A1 | 4/2016 | Guterman et al. |
| 2017/0005394 | A1 | 1/2017 | Wang et al. |

FOREIGN PATENT DOCUMENTS

| | | | |
|---|---|---|---|
| WO | 2014059382 | A1 | 4/2014 |
| WO | 2015011468 | A1 | 1/2015 |
| WO | 2017017429 | A1 | 2/2017 |

OTHER PUBLICATIONS

IEEE Transactions on Antennas and Propagation, vol. 63, No. 12, Dec. 2015, K L Wong et al., "Triple-wideband open-slot antenna for the LTE metal-framed tablet device", pp. 5966-5971.
International Search Report and Written Opinion for corresponding PCT Application No. PCT/GB2018/050434, dated Apr. 26, 2018, 24 pp.
Combined Search and Examination Report for GB Application No. 1802655.9, dated Aug. 10, 2018, 8 pp.
Examination Report for GB Application No. 1802655.9, dated May 15, 2020, 4 pp.

* cited by examiner

TRIPLE WIDEBAND HYBRID LTE SLOT ANTENNA

This application is a national stage application under 35 U.S.C. § 371 of PCT Application No. PCT/GB2018/050434, filed 19 Feb. 2018, which claims the benefit of Great Britain Application No. 1702748.3, filed 20 Feb. 2017 and Great Britain Application No. 1711909.0, filed 24 Jul. 2017. The entire contents of the PCT/GB2018/050434, Great Britain Application No. 1702748.3 and Great Britain Application No. 1711909.0 are incorporated herein by reference in their entirety.

This disclosure relates to a hybrid LTE slot antenna with triple wideband performance. Controlled matching of a first monopole surface conductor in conjunction with tuned slot elements, allows control of the low band independently of mid-high band slot performance.

BACKGROUND

Firstly, some of the terms used in the main Detailed Description will be defined to ensure that the reader is able to understand fully the concepts described therein.

In the context of the present application, a "balanced antenna" is an antenna that has a pair of radiating arms extending in different, for example opposed or orthogonal, directions away from a central feed point. Examples of balanced antennas include dipole antennas and loop antennas. In a balanced antenna, the radiating arms are fed against each other, and not against a groundplane. In many balanced antennas, the two radiating arms are substantially symmetrical with respect to each other, although some balanced antennas may have one arm that is longer, wider or otherwise differently configured to the other arm. A balanced antenna is usually fed by way of a balanced feed.

In contrast, an "unbalanced antenna" is an antenna that is fed against a groundplane, which serves as a counterpoise. An unbalanced antenna may take the form of a monopole antenna fed at one end, or may be configured as a centre fed monopole or otherwise. An unbalanced antenna may be configured as a chassis antenna, in which the antenna generates currents in the chassis of the device to which the antenna is attached, typically a groundplane of the device. The currents generated in the chassis or groundplane give rise to radiation patterns that participate in the transmission/reception of RF signals. An unbalanced antenna is usually fed by way of an unbalanced feed.

A balun may be used to convert a balanced feed to an unbalanced feed and vice versa.

A reconfigurable antenna is an antenna capable of modifying dynamically its frequency and radiation properties in a controlled and reversible manner. In order to provide a dynamical response, reconfigurable antennas integrate an inner mechanism (such as RF switches, varactors, mechanical actuators or tuneable materials) that enable the intentional redistribution of the RF currents over the antenna surface and produce reversible modifications over its properties. Reconfigurable antennas differ from smart antennas because the reconfiguration mechanism lies inside the antenna rather than in an external beamforming network. The reconfiguration capability of reconfigurable antennas is used to maximize the antenna performance in a changing scenario or to satisfy changing operating requirements.

BRIEF SUMMARY OF THE DISCLOSURE

The present Applicant proposes a hybrid triple wideband LTE slot antenna, comprising a feed arm in region of a main slot conductive member, and a controlled matching circuit at a first end of an unbalanced surface element.

Viewed from a first aspect, there is provided an antenna arrangement for a portable electronic device, the antenna arrangement comprising:

a conductive ground plane having an edge;

a substantially rectangular recess formed in the edge of the ground plane, the recess having a base, an open edge opposed to the base, and at least a first side extending from the base;

a first conductor element extending across the open edge of the recess, a first end of the first conductor element being connected to the ground plane at the first side of the recess, the first conductor element leaving at least one gap at the edge of the recess, such that the first conductor element, the first side of the recess and the base of the recess together define a slot in the ground plane and the at least one gap defines at least one notch in the slot;

at least a second conductor element disposed within the recess and connected to or configured to couple with the ground plane; and a feed arm for connection to an RF feed, the feed arm being disposed substantially within a footprint of the slot.

Embodiments of the present disclosure may provide a hybrid slot antenna, with operation in first and second higher bands supported by the second conductor element and the slot, and operation in a third, lower band supported by the first conductor element acting as an unbalanced antenna.

Some embodiments may further comprise a third conductor element disposed within the recess and connected to or configured to couple with the ground plane.

In some embodiments, the second and/or third conductor elements are electrically connected to the ground plane. However, it is also possible for one or other or both of the second and third conductor elements to float relative to RF ground (i.e. not be electrically connected to the ground plane) and instead couple electromagnetically with the ground plane to achieve similar results.

The second and/or third conductor elements may be serpentine or have a meander configuration. In other embodiments, the second and/or third conductor elements may have other shapes, for example a rectangular patch shape.

In some embodiments, the second conductor element comprises a first portion connected to and extending from the ground plane at the base of the recess towards the open edge, and a second lateral portion extending from the respective first portion away from the first side of the recess.

Where provided, the third conductor element may also comprise a first portion connected to and extending from the ground plane at the base of the recess towards the open edge, and a second lateral portion extending from the respective first portion towards the first side of the recess, such that the second lateral portions of the conductor elements extend away from each other within the recess.

The second and third conductor elements in this embodiment may be considered as having a counter-opposed configuration.

A first portion of the feed arm may be disposed alongside the second lateral portion of one of the second and/or third conductor elements so as to couple therewith. For example, the first portion of the feed arm may run substantially parallel and close to the second lateral portion of the second or third conductor element so as to allow strong coupling therebetween.

The first portion of the feed arm may be disposed alongside the second lateral portion of the second conductor element so as to couple therewith, and the third conductor element, where provided, may be closer to the first side of the recess than the second conductor element. For example, the first portion of the feed arm may run substantially parallel and close to the second lateral portion of the second conductor element so as to allow strong coupling therebetween.

The feed arm may be positioned approximately two thirds of the way along the second lateral portion of the second or third conductor element.

A second portion of the feed arm may be disposed alongside the first conductor element so as to couple therewith.

The feed arm may be configured to couple strongly with both the second conductor element and the first conductor element.

Strong coupling between first and second elements, such as between the feed arm and one or more of the first, second or third conductor elements, has the sense herein that an electrical excitation in a first element creates an electrical excitation in a second element, such that the position and configuration of the first element relative to the second influences the strength of the excitation, as known in the art. Means to achieve strong coupling will be known to the skilled person, but in a range of embodiments strong coupling may be said to exist when one or more of the following are true: the first element is close to the second element, such as having a separation less than 10 mm; a portion of the boundary of the first element is adjacent to, and spaced apart from a portion of the boundary of the second element, for example the boundary portions being parallel; the first and second elements have a similar geometrical layout on a surface, such as comprising one or more linear portions adjacent to and spaced apart from one another; the first and second elements are separated by a distance through a material, such as a substrate, such as being on a first and second opposing faces of a common substrate; the first and second elements are spaced apart on from another on two separate substrates, the elements facing one another across a gap between the substrates.

Strong coupling may be said to exist if a resonant condition may be excited between the first and second elements. The strength of the resonance may be indicative of the strength of the coupling. A first and a second element may be coupled strongly in a first frequency band and less strongly, or coupled weakly, in a different frequency band.

At least one of the first, second and third conductor elements may include at least one lumped passive component, selected from the group comprising: inductors, capacitors and resistors. The lumped passive components allow an electrical length of the respective conductor element to be changed or adjusted without having to change the physical length of the respective conductor element. This can make it easier to optimise the antenna for best performance. For example, including a lumped inductor in the first conductor element near its first end has been found to result in the smallest insertion loss and most efficient change of electrical length of the first conductor element.

The first conductor element may be configured as a substantially planar strip, the plane of the strip being substantially orthogonal to the ground plane. This can help the first conductor element to support a radiation pattern that is substantially orthogonal to radiation patterns generated by the other antenna components, thus helping to improve isolation.

The first conductor element may be configured as part of a casing or bezel of the portable electronic device. For example, the first conductor element may be formed on an inside surface of a casing. This may be achieved by laser direct structuring (LDS), or by printing or gluing a conductive strip to the inside of the casing. Alternatively, where the casing has an external metal bezel, part of the bezel may be configured as the first conductor element. Other, more traditional methods of manufacture can also be used; these include: providing the conductor elements on printed circuit board such as FR-4, or on a flexible circuit substrate and wrapped on a dielectric carrier structure.

The first conductor element may be provided with switching and/or matching circuitry. For example, an impedance matching circuit may be connected between the first end of the first conductor element and the ground plane. In some embodiments, an RF switch is provided between the first end of the first conductor element and the ground plane, allowing selection between different matching circuits. For example, there may be provided at least two different matching circuits between the first end of the first conductor element and the ground plane, the matching circuits comprising different lumped components such as capacitors and/or inductors and optional resistors. By operating the RF switch to switch between different matching circuits, an effective electrical length of the first conductor element can be tuned or dynamically changed without needing to change the physical length of the conductor element.

In some embodiments, there may further be provided a fourth conductor element extending from the ground plane at the second edge of the recess, across the open edge of the recess towards the second end of the first conductor element, wherein the gap is defined between mutually adjacent ends of the first and fourth conductor elements, and wherein the first and fourth conductor elements together form a coupled line across the open edge of the recess. The fourth conductor element may act as a coupled line extension of the first conductor element, and allows the gap defining the notch in the slot to be positioned at any desired location along the open edge of the recess. This allows for optimization of the antenna arrangement and can extend the bandwidth of the antenna arrangement by, for example, enhancing the quality factor in the low bands. The fourth conductor element may also be provided with switching and/or matching circuitry. The switching and/or matching circuitry may be provided at an end of the fourth conductor element furthest from the gap.

In some embodiments, the feed arm is provided with switching and/or matching circuitry.

The feed arm may be disposed in a plane substantially parallel to the ground plane and the recess.

The ground plane may be formed in or on a printed circuit board (PCB). The second and, where provided, third conductor elements may be formed on one surface of the PCB, and the feed arm may be formed on an opposed surface of the PCB. For example, the ground plane and the second and third conductor elements may all be formed on one surface of the PCB, and the feed arm may be formed on the opposed surface of the PCB. Where appropriate, the various switching and/or matching circuits may also be disposed on the PCB. The PCB may be a multilayer PCB.

The feed arm may have a shape or configuration selected from the group comprising: L-shaped, Π-shaped, and U-shaped. In certain embodiments, the feed arm has lateral portions that run alongside or overlap respective lateral portions of the first and/or second and/or third conductor elements so as to allow strong coupling therewith, and connecting portions between the lateral portions or between the RF feed and a lateral portion, the connecting portions being substantially orthogonal to the lateral portions so as to reduce or avoid coupling between the connecting portions and the lateral portions and/or the conductor elements.

In some embodiments, the antenna arrangement may further comprise a proximity sensor, for example to detect a proximity of a human body part. If it is determined that a human body part is close to the antenna arrangement, the power to the RF feed can be adjusted so as to reduce specific absorption rate (SAR) to acceptable levels, and/or to tune the antenna arrangement so as to compensate for the presence of the human body part.

In some embodiments, the recess may have a second side extending from the base, the second side being opposed to the first side. In these embodiments, the recess is bounded on three sides by the ground plane.

In other embodiments, the recess may be open or substantially open on a side opposed to the first side. In these embodiments, the recess is bounded only on two adjacent sides by the ground plane.

The antenna arrangement may be configured such that the second and third conductor elements together operate in mid to high bands, with the first (and optional fourth) conductor element operating in a low band (the terms low, mid and high are used here simply as convenient labels to describe the relative band frequencies). Where the second conductor element is coupled to the feed arm, the third conductor element can couple with the second conductor element and/or with a resonance of the slot so as to broaden the response across a wider bandwidth. This can help to provide broadband performance over mid and high bands.

The second and third conductor elements can define channels in the slot formed by the recess and the first (and optional fourth) conductor element, and can thus define at least one open slot antenna. The second conductor element can act to form an RF slot path, and the third conductor element can couple therewith to act as a broadbanding element.

In some embodiments, the antenna arrangement can operate in a hybrid mode, offering resonances from both the open slot configuration and also from a coupled loop configuration due to the first (and optional fourth) conductor element and a conductive pathway in the ground plane around the edges of the recess, operating as an unbalanced radiator.

Two or more antenna arrangements of the present disclosure may be provided on an edge of a ground plane, or on different edges of a ground plane. For example, a ground plane may be defined by a main PCB of a mobile phone handset, or by a main PCB of a screen part of a laptop computer.

Embodiments of the present disclosure may support MIMO or beam-forming operation.

Certain embodiments are not sensitive to the ground-plane size. Certain embodiments do not require a complicated matching circuit on the feed, therefore the size can be decreased. Certain embodiments have the ability to cover future additional low bands. Lower bands can be altered without affecting the mid and high bands.

Furthermore, certain embodiments are of decreased size for implementation into device casing, which is technically convenient and aesthetically pleasing. Some embodiments allow a reduced component count and thus cheaper manufacture.

BRIEF DESCRIPTION OF THE DRAWINGS

Embodiments of the invention are further described hereinafter with reference to the accompanying drawings, in which.

DETAILED DESCRIPTION

Figure 1:
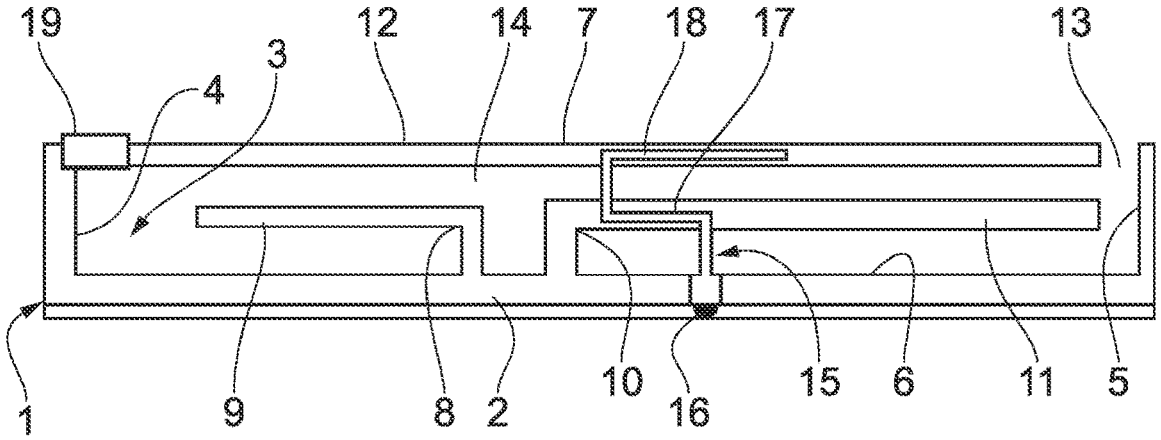
FIG. 1 is a schematic view of a first embodiment from a front side.

Wth the current advancement of technology in mobile telecommunications devices such as tablets, laptops and smartphones, the trend is towards supporting more wireless standards and being thinner and more aesthetically desirable.

Current wireless services include the use of 4G LTE, a fast cellular data service for networking as WWAN (wireless wide area network). This is similar to WLAN (wireless local area network) operation but utilises fast cellular data protocols such as 4G LTE or even 5G as the data backhaul.

The desire for thinner devices often requires the use of metal monocoque shells which do not offer good passage of RF signals from an antenna. This is especially a problem for WWAN frequencies and coupled with being placed in close proximity to other antenna, and or electronic components on the motherboard, provides a challenge for any antenna design to work over multiple bands.

It is known to use plastic windows in metal covers or shells, in order that RF signals can pass easily, but this can deter from the aesthetic design of the device and is sometimes associated with the less premium models in a range. Other solutions include creating insulated slots in a rim around casing to create either dipole, or monopole antenna elements such as on the iPhone4®. However, these are particularly susceptible to user intervention by shorting across the elements with the hand or fingers during use, which results in degradation of the signal.

Another solution is to use slot antenna arrangements. These types of antenna utilise a slot of free space that is bounded by metal elements, or ground-plane, to create a box; and having a small opening or notch in the casing. The shape, size and number of the free-space paths bounded by the radiator elements in the box, defines the particular resonances that will occur, and hence the frequencies over which the device will operate.

This solution is typically less susceptible to outside intervention by fingers or hands blocking the slot or notch and allows more complex designs of resonating structure to be implemented behind the casing, which is not feasible for monopole or dipoles using the casing as radiating elements. The solution also looks aesthetically pleasing as the requirement for slots (that require insulating) and therefore have a different look, colour, or feel to the metal than previous designs.

Papers in the prior art describe use of particular metal structures being added to the main slot in order that particular frequency bands can be covered and also tuning circuitry can be added to the feed arm in order to widen the response across active frequency bands. Both of these techniques allow the slot antenna to meet requirements for the challenging operation in the low, medium and high bands used for LTE. However complicated tuning circuitry can add to the footprint of the antenna and therefore require the bezel, rim or edge of the aesthetic device to be larger than ideally required.

It is therefore proposed a hybrid open-slot antenna design that can overcome the previous described problems in that it can implemented in the most current thin, metal casings in mobile devices, is less susceptible to degradation of the RF signal by user intervention, does not create large slots or gaps in the cosmetic casing, has a small footprint, and can operate over a broad range of frequencies.

A first embodiment of the present disclosure provides a design for a triple-wideband hybrid LTE slot antenna. The antenna is illustrated in FIG. 1, which shows a portion of an edge of a PCB 1 of a portable electronic device (not shown). The PCB 1 incorporates a conductive ground plane 2 and a recess 3 formed in the ground plane 2. The recess 3 has first 4 and second 5 opposed sides, a base 6 and an open edge 7 opposed to the base 6. A first conductor element 12 extends from the first side 4 of the recess 3, across the open edge 7, towards, but not touching, the second side 5 of the recess 3, leaving a gap 13. A second, L-shaped, conductor element 10 extends from the base 6 of the ground plane 2 and has a lateral arm 11 extending towards, but not touching, the second side 5 of the recess 3. A third, L-shaped, conductor element 8 extends from the base 6 of the ground plane 2 and has a lateral arm 9 extending towards, but not touching, the first side 4 of the recess 3.

The base 6 of the ground plane 2, the first and second sides 4, 5 of the recess 3 and the first conductor element 12 together define a main slot 14 in the ground plane 2. A feed arm 15 is connected to an RF feed 16 and is disposed substantially within a footprint defined by the main slot 14. The feed arm 15 comprises lateral portions 17, 18 which are configured to couple respectively with the lateral arm 11 of the second L-shaped conductor 10 and the first conductor element 12 during operation of the antenna.

The first conductor element 12 may be connected directly to the ground plane 2 at the first side 4 of the recess 3, or may advantageously be connected to the ground plane 2 by way of a controlled matching circuit 19. The gap 13 is configured to define a notch in the main slot 14.

The first conductor element 12, which may form part of an exterior metal casing of the portable electronic device, is the conductive element mainly responsible for resonances in the low band. The second and third conductor elements 10, 8 are the conductive elements mainly responsible for the middle and high bands, whereby element 8 provides a broad-banding effect in the response of element 10, thereby providing a wider frequency response in both the middle and high frequency bands. In summary, this structure is a hybrid slot antenna with the properties of the mid and high bands being supported by the elements 8, 10 and the main slot 14; and the lower bands being supporting by the unbalanced (in this case monopole PI FA) antenna created by the conductive element 12. In this example elements 8 and 10 are directly connected to the ground plane 2, but they could be floated and electromagnetically couple with the ground plane 2 to have similar results. Additionally, while elements 8 and 10 are illustrated as being substantially L-shaped, they could be other shapes such as rectangular patches or serpentine lengths, or any shape which provides the required slot response to operate in the tri-band LTE frequency range.

As already discussed, previous solutions require complex matching circuitry on the feed arm or complicated conductor shapes to be present in the main slot in order to precisely match the LTE frequency ranges, however this is not particularly suited for small form factor. Embodiments of the present disclosure achieve the required frequency response by the addition of the broad-banding element 8 in the main slot 14 which creates an additional resonance responsible for performance in the mid and high bands. This is illustrated in FIG. 2.

Figure 2:
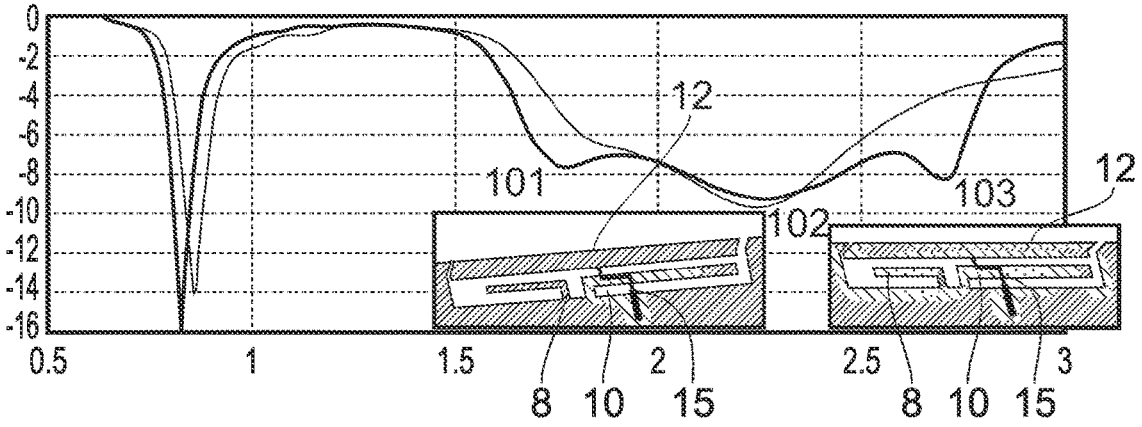
FIG. 2 shows mid- and high-resonances due to the second and third conductor elements of the embodiment of FIG. 1, with surface currents shown in the inset portions.

FIG. 2 illustrates the contributions of the conductive elements 8 and 10 to the mid and high frequency resonances, with the surface current distributions inset. Resonances at 101 and 102 are from the conductive element 10 and the additional resonance 103 is created by addition of conductive element 8 into the slot 14. This gives a more reliable 1.6-2.8 GHz response in the mid and high bands.

A simpler design of the antenna can omit conductive element 8. This may result in the highest operating frequencies being removed, however such a structure may be useful in the WLAN (W-Fi) frequency range which does not need to cover the higher frequencies of LTE bands.

Complex circuitry is not required on the feed arm 15. The first conductive element 12 responsible for the low band may, however, be provided with a controlled matching circuit 19. This may be configured as a small form-factor passive circuit 19 and allows the effective electrical length of the conductive element 12 to be changed, using a simple circuit with low component count. Therefore, the low frequency band response can be widened and potentially include bands that are not yet ratified by the relevant standards bodies for future-proofing.

As indicated in FIG. 1, the controlled matching circuit 19 may be located in between the ground plane 2 and the first end (left to right) of the first conducting element 12. This position, at the end farthest from both the feed arm 15 and the second conductive element 10 is the most effective in some embodiments. Surface currents in the low frequency resonance are most concentrated in this area and therefore the altering of capacitances or inductances (or combinations thereof) in the controlled matching circuit 19 can more efficiently alter the effective length of the first element 12. The surface current distributions for the low band resonances are illustrated in FIG. 3.

Figure 3:
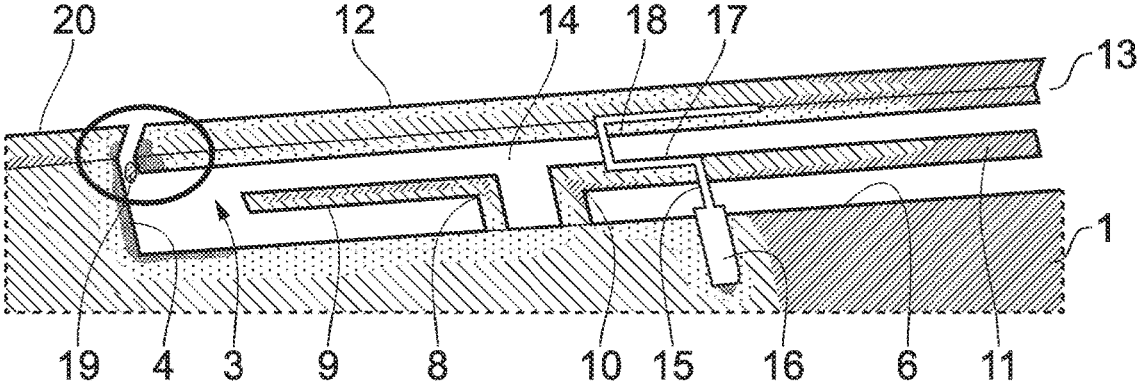
FIG. 3 is an alternative schematic view of the embodiment of FIG. 1 with surface currents shown.

FIG. 3 also shows that, in certain embodiments, the first conductor element 12 may be disposed substantially orthogonal to a plane of the ground plane 2. In the illustrated embodiment, the first conductor element 12 has a bracket- or L-shaped cross-section. This can help to promote radiation patterns that are orthogonal to other radiation patterns generated by other parts of the hybrid antenna, thus improving isolation. An edge part 20 of the ground plane 2 may also be angled orthogonally to the main plane of the ground plane 2 as shown.

Figure 4:
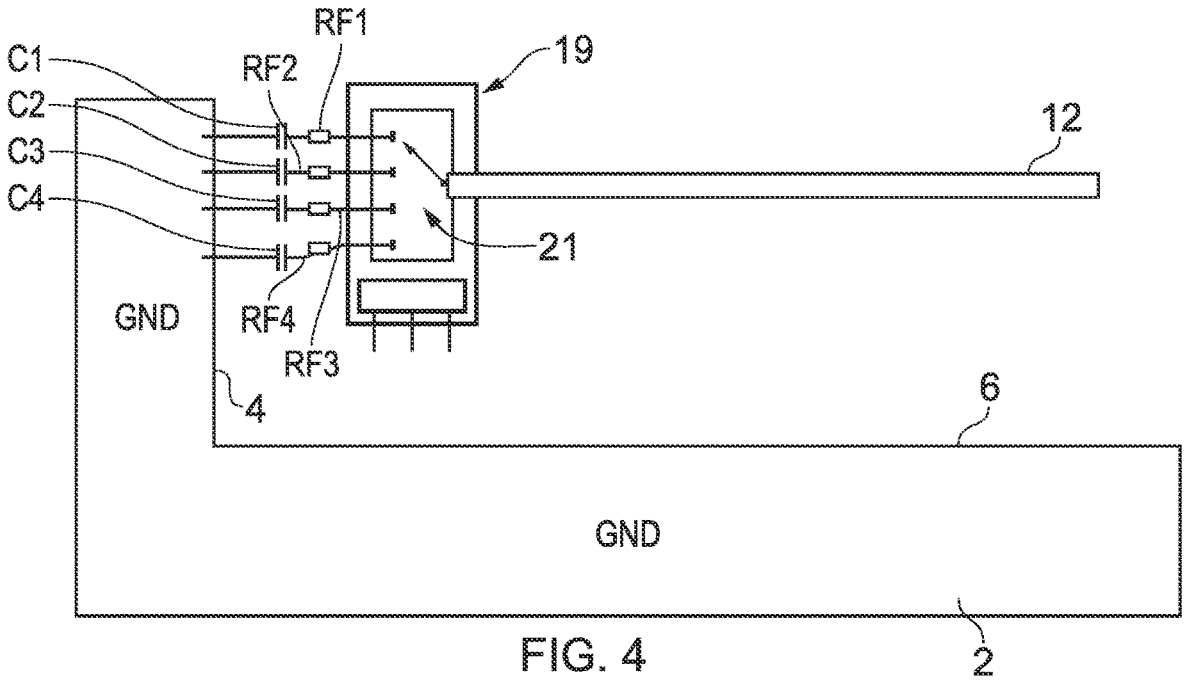
FIG. 4 shows a schematic view of a controlled matching and switching circuit between the first conductor element and the ground plane.

A simple controlled matching circuit 19 arrangement for an embodiment of the invention is illustrated in FIG. 4, which shows a single-pole, four-throw (SP4T) RF switch 21 connected to the low band first conductive element 12 on one side and to and to four different capacitances C1 to C4 via links RF1-RF4. The capacitances could be replaced with inductances or the arrangement implemented as a variable capacitance or a network circuit comprising either. Other types of RF switch could be used, such as two single-pole, double-throw (SPDT) etc. depending on availability or cost or other factors. In broader terms this element could be seen as a controlled matching circuit 19 present on the top or first conductive element 12.

The switching arrangement is also required to be near to, or on, the ground plane 2, as it needs to be addressed by digital control lines and requires a voltage supply. All of these requirements mean that conductors or wires need to be routed to the device and this is best done over the ground plane 2 so that no coupling will occur with the elements in the antenna itself.

Figure 5:
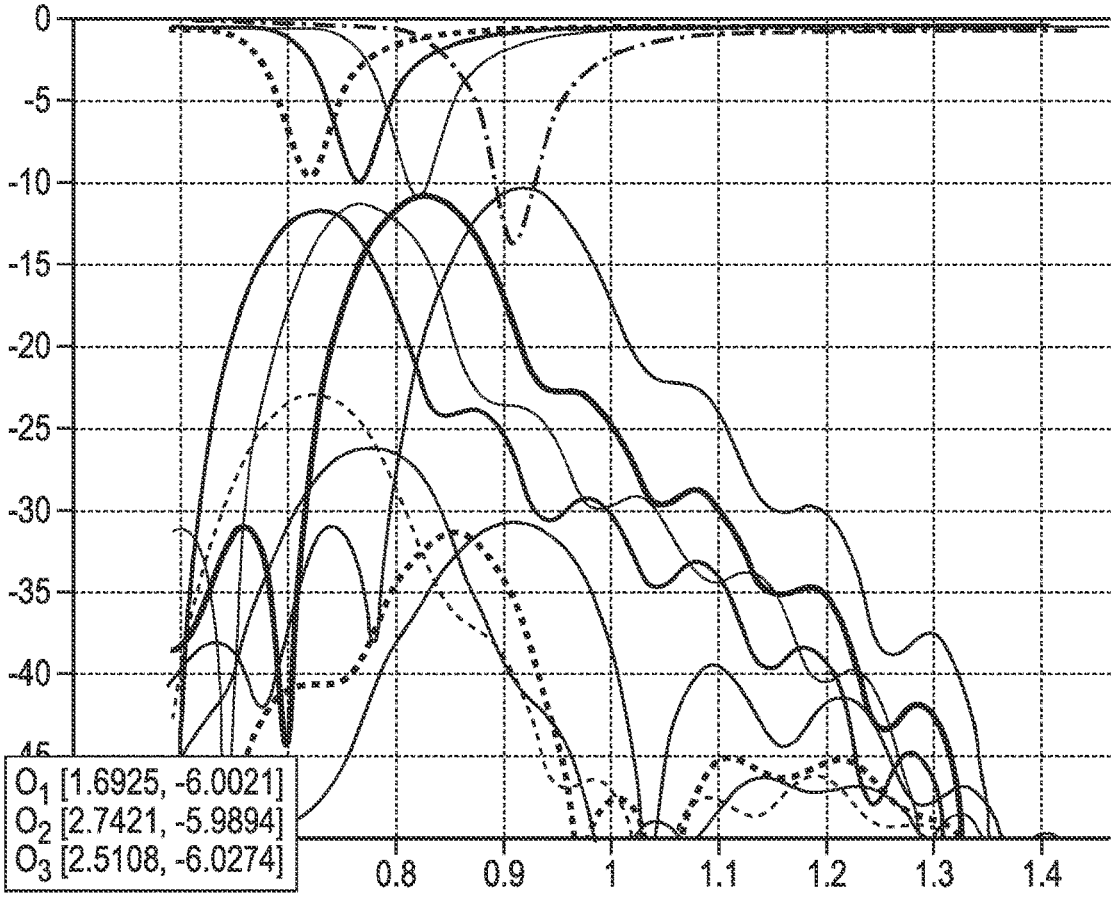
FIG. 5 shows how resonances can be adjusted by using the controlled matching and switching circuit of FIG. 4.

The response of the first conductor element 12, as the switch controls the capacitance, and hence the effective electrical length and resonance, is illustrated in FIG. 5.

This particular example switches between four different capacitances: as the capacitance increases, the electric length increases and therefore the frequency of the resonance is lowered. Table 1 below summarises the capacitance used and the resultant resonant frequency.

TABLE 1

Resonance versus capcitance

| Capacitance | Resonance |
|---|---|
| 68 pF | 699 MHz |
| 14 pF | 745 MHz |
| 7 pF | 880 MHz |
| 3 pF | 960 MHz |

Similarly, if inductances were used, the higher the inductance, the longer the effective electrical length of conductive element 12, and hence the lower the resonant frequency. This property is a result of the hybrid nature of the slot antenna, the lower bands can be altered without affecting the mid or high bands. The switches are connected to a control processor. It is possible for the control processor to take information from the specific RF module, for example received signal strength indicator (RSSI) or other metrics derived from the module baseband processor in order to control the switching process. This design enables the antenna to be able to cover future bands as they become approved for use in the low-band regime by adjusting the capacitances (or other components) used with the switch.

Wth respect to the feed arm 15 in the antenna design, this can be disposed in a second layer, which is different from the layers forming the ground plane 2 and the conductive elements 8, 10, 12. The feed arm 15 is required to couple with both the second and first conductive elements 10 and 12 and the main slot 14 in a particular location in order to produce the best coverage of the mid and high frequency bands. The feed arm 15 is substantially pi- or u-shaped in this embodiment, but it could be other shapes such as L-shaped or a simple patch, or any reasonable shape which provides the interaction with the conductive elements 10, 12 and the slot 14 to achieve the wideband resonances required.

Experimentation has shown that the feed arm 15 can be placed approximately two-thirds the way along the first conductive element 12 for good performance. The feed arm 15 needs to interact with both conductive elements 10 and 12, and should not be positioned too close to the ground point of conductive element 10. Preferably, the RF feed 16 and/or the feed arm 15 are located away from the end of the recess 3 where the controlled matching circuit 19 is located.

Figure 6:
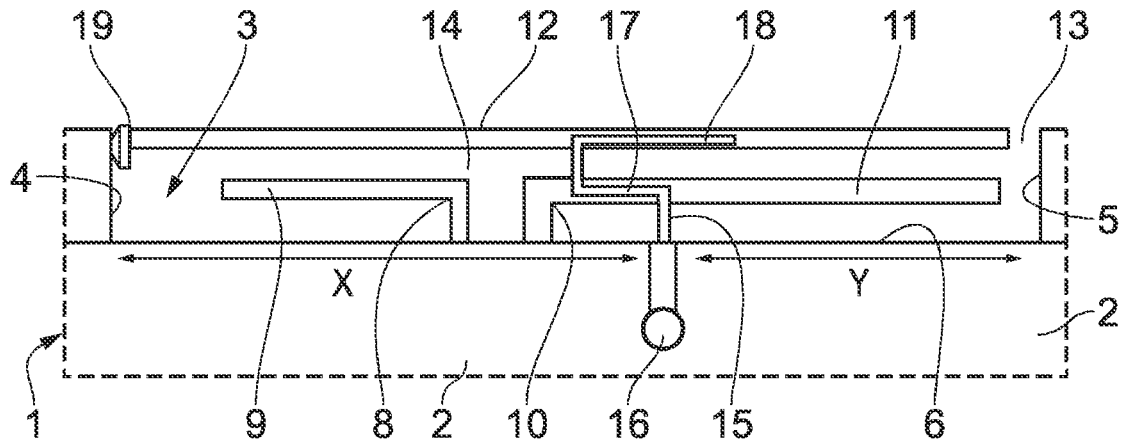
FIG. 6 shows an alternative schematic view of the embodiment of FIGS. 1 and 3.

This concept is summarised in FIG. 6. The requirements for the positioning of the feed arm 15 and the RF feed 16 are that X>Y, and in some embodiments X-2'Y. It will be understood that this relationship may be altered by the shape of conductive elements 8, 10, 12 in the slot 14, and the shape of the feed arm 15, or the particular frequencies to be tuned in the mid and high bands.

Figure 7:
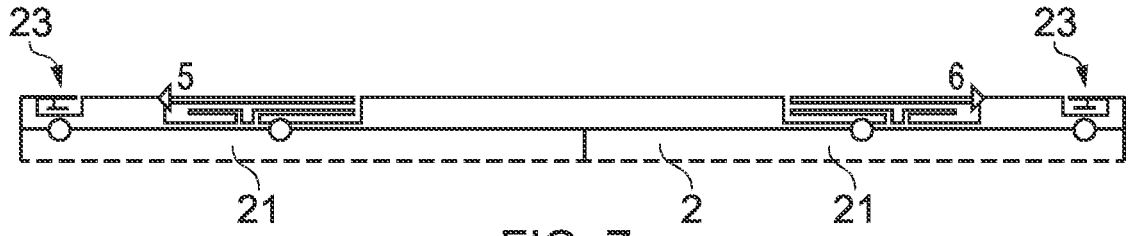
FIG. 7 shows a pair of antennas of the FIGS. 1 and 3 embodiments together with a pair of WLAN antennas.

The antenna design can be embedded, for example, in the top edge of a high-end laptop screen, which has a thin metal bezel and casing. An array of such elements could be included to support MIMO and beam-forming, and included alongside other similar slot design antenna elements configured to operate at other frequencies, such as WLAN FIG. 7 illustrates how an arrangement of two of the hybrid antennas 22 of the present disclosure could be arranged, and supplemented by inclusion of similar slot-type WLAN antenna elements 23.

Further, in response to the international legislation on limits for specific absorption rates (SAR) for wireless devices, techniques are being used to actively manage the amount of radiation being directed into human tissue. One such technique uses sensors to detect whether human tissue is near to an RF emitter and actively shutting down a particular emitter, or reducing the output power. Such sensors could be selected from optical, infra-red (heat), capacitive or other to provide a reliable indication of the approach and distance to a human body from the antenna.

The current system could employ a proximity sensor or P-Sensor located in the near vicinity, or even forming part of the antenna structure, in the case of a capacitive sensor. The sensor is connected to the control processor such that in response to a particular value or threshold of values, the digital control to the antenna elements can be altered such that one or all of the following are achieved: 1. Radiating element configuration is changed; 2. power transferred from the RF Frontend is lowered; and/or 3. the antenna element is switched off altogether. This enables dynamic power, radiation pattern and active antenna element reconfiguration in response to human tissue in the near environment.

The embodiment outlined above has all of the conductive elements 8, 10 and 12 in the same layer as the ground plane 2 with the feed arm 15 in a second layer. However, other embodiments could employ multilayer designs whereby one or more of the conductive elements 8, 10, 12 in the slot 14 are located in a second layer and the feed arm 15 is on the first layer (where the ground plane 2 is located). Variations in the layer design allows the feed arm 15 to be disposed entirely within the slot 14 and not have any portion protruding, especially when it is on the same layer as the ground plane 2 rather than being above it.

It is well known that antenna devices designed, simulated and optimised in test-rigs will have slightly different behaviour once introduced into a real-world mobile device. This can be due to unforeseen factors such as more metal chassis components, cabling routings, materials having different electromagnetic properties than anticipated, and electromagnetic noise from nearby electronic components.

In a most recent implementation of an embodiment of the present disclosure, an antenna system has been designed to reside in a very compact screen bezel of a thin form-factor ultrabook type laptop. Subsequent optimisations to maintain performance in such a challenging environment have led to the following embodiment.

Figure 8:
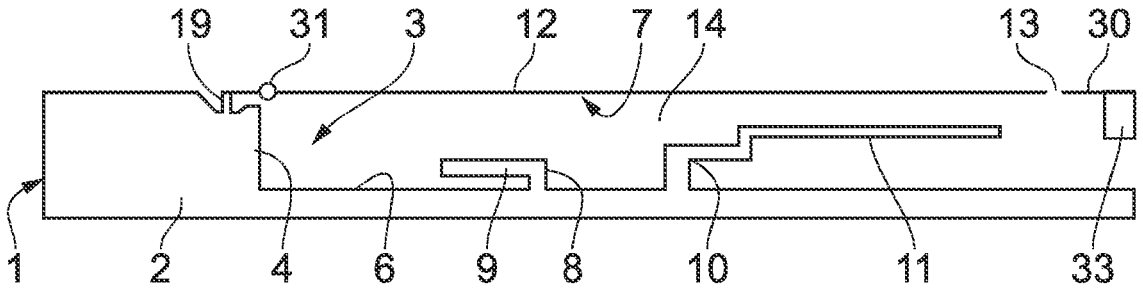
FIG. 8 is a schematic view of a second embodiment from a front side.

With reference to FIG. 8, some extra features have been added to improve performance. It can be seen that in this embodiment, the recess 3 is bounded only on two adjacent sides by the ground plane 2, namely at a first side 4 and along the base 6, leaving the slot 14 open at the right-hand end in FIG. 8. The first conductor element 12 is shorter than in the previously described embodiment, terminating short of the full length of the recess 3. A fourth conductor element 30 is disposed adjacent to the end of the first conductor element 12, leaving a gap 13. The fourth conductor element 30 forms a coupled line together with the first conductor element 12. The fourth conductor element 30 may extend around a corner of the right-hand end of the recess 3 as indicated at 33, thus providing extra length for the coupled line within the confines of a small available space. This allows the gap 13, which defines the notch in the main slot 14, to be moved away from the right-hand end of the recess 3 as viewed in FIG. 8. This can enhance low band resonances, and the position of the gap 13 can be optimised, with the fourth conductor element 30 forming an extended coupled element, which couples with the first conductor element 12, and acts as a broad-banding feature to enhance the quality factor, Q, of the low bands.

A lumped component 31 can be added to tune the electrical length of the first conductor element 12. The lumped component 31 can be an inductance, a capacitance or any other passive component or combinations of such, as required. The lumped component 31 is not essential, but can be useful depending on the particular frequency requirements of the antenna and enables operational characteristics to be optimised without physically changing the size or length of the first conductor element 12. The position of the lumped component 31, located just after the controlled matching circuit 19, has been found by experimentation to be optimal, and offers the least insertion loss and the most efficient change of electrical length of the first conductor element 12.

The interface, feeding, and switching circuits to tune for the multiple low bands of LTE are located on the ground plane 2. For example, the controlled matching circuit 19 can be installed at the position shown, and associated circuitry and passive components can be mounted on a PCB on the ground plane 2.

FIG. 8 also shows the second and third conductor elements 10, 8 extending from the base 6 of the recess 3, connected to the ground plane 2.

Figure 9:
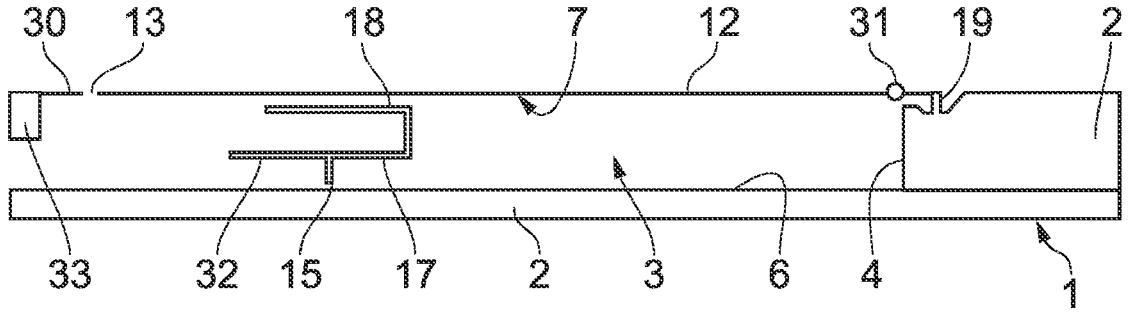
FIG. 9 is a schematic view of the embodiment of FIG. 8 from a rear side.

FIG. 9 shows a rear view of the arrangement of FIG. 8, showing the feed arm 15 which is in a different plane to the ground plane 2 and the second and third conductor elements 10, 8. The feed arm 15 has been modified to include an extra arm or extension 32. The extra length provided by the extension 32 helps with the higher frequency 5 GHz LAA band. The feed arm 15 arrangement is configured such that the arms of the U-shape run alongside the first (low band) conductor element 12 and the second (mid-high band) conductor element 10 (positioned on the front side of the PCB) and couple therewith. By extending the coupling to the second conductor element 10, an improvement can be made in the high-band performance.

Figure 10:
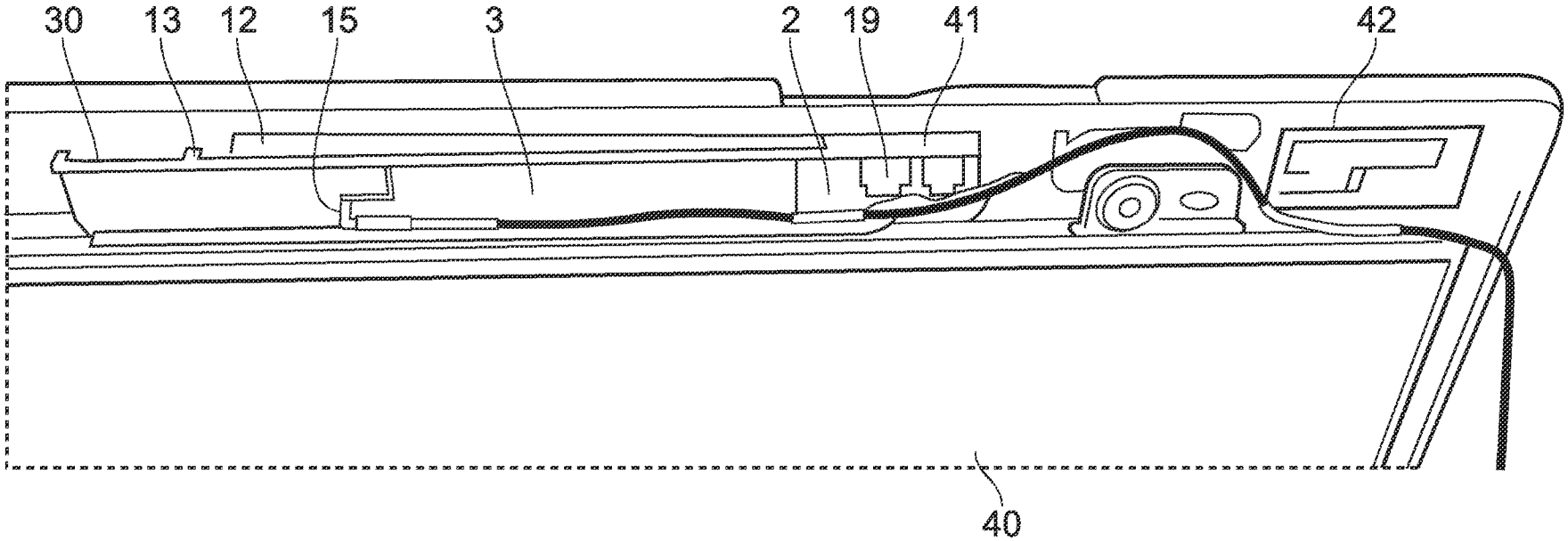
FIG. 10 is an alternative schematic view of the embodiment of FIGS. 8 and 9 installed in an edge portion of a screen of a laptop computer.

FIG. 10 shows the antenna device installed in the top bezel of a screen 40 of a compact ultrabook type laptop. The entire assembly only has a footprint of 6.5-7.5 mm in height. This view shows the rear PCB containing the feed arm 15 and the perpendicular first conductor element 12 member can be seen, along with the coupled-line fourth conductor element 30 to the left. On the right of the assembly can be seen a PCB 41 installed on the large ground plane 2 with the connectors, passive components, and the switch 19 to match the first conductor element 12 in the low bands. In the right hand corner is an associated WLAN antenna 42 forming part of the installation for LTE and WLAN functionality.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. An antenna arrangement for a portable electronic device, the antenna arrangement comprising:

a conductive ground plane having an edge;

a substantially rectangular recess formed in the edge of the ground plane, the recess having a base, an open edge opposed to the base, and at least a first side extending from the base;

a first conductor element extending across the open edge of the recess, a first end of the first conductor element being connected to the ground plane at the first side of the recess, the first conductor element leaving at least one gap at the edge of the recess, such that the first conductor element, the first side of the recess and the base of the recess together define a slot in the ground plane and the at least one gap defines at least one notch in the slot;

at least a second conductor element disposed within the recess and connected to or configured to couple with the ground plane; and a feed arm for connection to an RF feed, the feed arm being disposed substantially within a footprint of the slot.

2. The antenna as claimed in claim 1, further comprising a third conductor element disposed within the recess and connected to or configured to couple with the ground plane.

3. The antenna as claimed in claim 1, wherein the second and/or third conductor elements are serpentine or have a meander configuration.

4. The antenna as claimed in claim 1, wherein the second and/or third conductor elements have a patch configuration.

5. The antenna arrangement as claimed in claim 2, wherein the second conductor element comprises a first portion connected to and extending from the ground plane at the base of the recess towards the open edge, and a second lateral portion extending from the first portion away from the first side of the recess.

6. The antenna arrangement as claimed in claim 5, wherein the third conductor element comprises a first portion connected to and extending from the ground plane at the base of the recess towards the open edge, and a second lateral portion extending from the first portion towards the first side of the recess, such that the second lateral portions of the second and third conductor elements extend away from each other within the recess.

7. The antenna arrangement as claimed in claim 5, wherein a first portion of the feed arm is disposed alongside the second lateral portion of one of the second and/or third conductor elements so as to couple therewith.

8. The antenna arrangement as claimed in claim 7, wherein the first portion of the feed arm is disposed alongside the second lateral portion of the second conductor element so as to couple therewith, and wherein the third conductor element is closer to the first side of the recess than the second conductor element.

9. The antenna arrangement as claimed in claim 5, wherein a second portion of the feed arm is disposed alongside the first conductor element so as to couple therewith.

10. The antenna arrangement as claimed in claim 9, wherein the feed arm is configured to couple strongly with both the second conductor element and the first conductor element.

11. The antenna arrangement as claimed in claim 1, wherein at least one of the first, second and third conductor elements includes at least one lumped passive component, selected from the group comprising: inductors, capacitors and resistors.

12. The antenna arrangement as claimed in claim 1, wherein the first conductor element is configured as a substantially planar strip, and wherein the plane of the strip is substantially orthogonal to the ground plane.

13. The antenna arrangement as claimed in claim 1, wherein the first conductor element has an L-shaped cross-section.

14. The antenna arrangement as claimed in claim 1, wherein the first conductor element is configured as part of a casing or bezel of the portable electronic device.

15. The antenna arrangement as claimed in claim 1, wherein the first conductor element is provided with switching and/or matching circuitry.

16. The antenna arrangement as claimed in claim 1, further comprising a fourth conductor element extending across the open edge of the recess, wherein the gap is defined between mutually adjacent ends of the first and fourth conductor elements, and wherein the first and fourth conductor elements together form a coupled line across the open edge of the recess.

17. The antenna arrangement as claimed in claim 16, wherein the fourth conductor element is provided with switching and/or matching circuitry.

18. The antenna arrangement as claimed in claim 15, wherein the switching and/or matching circuitry includes an RF switch configured to allow connection of the first or fourth conductor element between different capacitances.

19. The antenna arrangement as claimed in claim 1, wherein the feed arm is provided with switching and/or matching circuitry.

20. The antenna arrangement as claimed in claim 1, wherein the feed arm is disposed in a plane substantially parallel to the ground plane and the recess.

21. The antenna arrangement as claimed in claim 1, wherein the ground plane is formed in or on a printed circuit board (PCB).

22. The antenna arrangement as claimed in claim 21, wherein the second and third conductor elements are formed on one surface of the PCB, and wherein the feed arm is formed on an opposed surface of the PCB.

23. The antenna arrangement as claimed in claim 1, wherein the feed arm has a configuration selected from the group comprising: L-shaped, Π-shaped, and U-shaped.

24. The antenna arrangement as claimed in claim 1, further comprising a sensor to detect a proximity of human tissue.

25. The antenna arrangement as claimed in claim 24, further comprising control circuitry to reduce a radiated power of the antenna arrangement in response to detection of the proximity of human tissue by the sensor.

26. The antenna arrangement as claimed in claim 1, wherein the recess has a second side extending from the base, the second side being opposed to the first side.

27. The antenna arrangement as claimed in claim 1, wherein the recess is open on a side opposed to the first side.

* * * * *